US010165886B2

(12) United States Patent
Little et al.

(10) Patent No.: US 10,165,886 B2
(45) Date of Patent: Jan. 1, 2019

(54) BUTTON MANIPULATION DEVICE AND METHOD OF USE THEREOF

(71) Applicants: Jesse T. Little, Lindenhurst, NY (US); Timothy S. Little, Lindenhurst, NY (US)

(72) Inventors: Jesse T. Little, Lindenhurst, NY (US); Timothy S. Little, Lindenhurst, NY (US)

( * ) Notice: Subject to any disclaimer, the term of this patent is extended or adjusted under 35 U.S.C. 154(b) by 0 days.

(21) Appl. No.: 15/728,030

(22) Filed: Oct. 9, 2017

(65) Prior Publication Data

US 2018/0332991 A1 Nov. 22, 2018

Related U.S. Application Data

(60) Provisional application No. 62/506,919, filed on May 16, 2017.

(51) Int. Cl.
*A47G 25/92* (2006.01)
*A47G 25/90* (2006.01)

(52) U.S. Cl.
CPC ..... *A47G 25/90* (2013.01)

(58) Field of Classification Search
CPC ..... A47G 25/90; A47G 25/92
See application file for complete search history.

(56) References Cited

U.S. PATENT DOCUMENTS 311,539 A * 2/1885 Smith ..... A47G 25/92 24/40
D16,766 S * 7/1886 Brittin ..... D2/643
459,612 A * 9/1891 Hicks ..... A47G 25/92 24/40
725,166 A * 4/1903 Sommer ..... A47G 25/92 24/40
790,160 A * 5/1905 Smith ..... A44B 5/002 24/100
825,790 A * 7/1906 York ..... A47G 25/92 24/40
894,190 A * 7/1908 Crane ..... A47G 25/92 24/40
966,172 A * 8/1910 Davidoff ..... A43D 95/28 24/40
979,342 A * 12/1910 Schaefer ..... A47G 25/92 24/40
1,008,238 A * 11/1911 Bretsnyder ..... A47G 25/92 24/40
1,074,905 A * 10/1913 Smith ..... A47G 25/92 2/141.1

(Continued)

OTHER PUBLICATIONS amazon.com, "Good Grips / Sure Grips Button Hook," https://www.amazon.com/Good-Grips-Sure-Button-Hook/dp/B0006Z3GYG.

*Primary Examiner* — Jason W San

(57) ABSTRACT

A button manipulation device and method of use thereof for directly controlling a button are disclosed. The button manipulation device directly engages and secures a button for greater control while fastening the button through the buttonhole, which may be particularly useful for those with limited use of their hands. Furthermore, directly controlling the button through the buttonhole, rather than pulling the button through the buttonhole by the button thread, reduces the risk of damaging the thread and the material surrounding the buttonhole.

14 Claims, 8 Drawing Sheets

(56) References Cited

U.S. PATENT DOCUMENTS 1,084,399 A * 1/1914 Collins ..... A47G 25/92 24/40
1,084,424 A * 1/1914 Goldstein ..... A47G 25/92 24/40
1,101,557 A * 6/1914 Lister ..... A47G 25/92 24/40
1,125,366 A 1/1915 Meitz
D47,096 S * 3/1915 Baumann ..... 24/40
1,306,790 A * 6/1919 Vogel ..... A43D 95/28 24/40
1,425,760 A * 8/1922 Forzly ..... A47G 25/92 24/40
1,540,810 A * 6/1925 Simon ..... A47G 25/88 223/113
1,879,903 A * 9/1932 Kleiber ..... A47G 25/92 24/40
2,912,733 A * 11/1959 Layman ..... A61F 2/588 24/40
4,607,543 A * 8/1986 Mah ..... B67B 7/16 81/3.09
4,633,740 A * 1/1987 Jacobs ..... B67B 7/16 7/151
4,942,646 A * 7/1990 Sebastian ..... A47G 25/92 24/40
4,949,600 A * 8/1990 Tricinella ..... B67B 7/44 81/3.09
4,967,622 A * 11/1990 Phillips ..... B67B 7/44 7/151
4,976,172 A * 12/1990 Thomas ..... B67B 7/44 7/151
5,267,494 A * 12/1993 Waluda ..... E05B 19/00 81/3.09
5,276,948 A * 1/1994 Steadman ..... A47G 25/92 24/40
5,347,688 A * 9/1994 Ross ..... A47G 25/92 24/40
D382,784 S * 8/1997 Kagiyama ..... 81/3.55
5,771,759 A * 6/1998 Warren ..... B67B 7/403 81/3.09
6,446,312 B1 * 9/2002 Kabat ..... A47G 25/92 24/40
6,578,397 B1 6/2003 Altrich et al.
6,704,973 B1 * 3/2004 Naham ..... A47G 25/92 24/40
7,721,394 B2 * 5/2010 Snyder ..... A47G 25/92 24/40
7,827,884 B2 * 11/2010 Lawson ..... B67B 7/16 81/3.09
8,205,527 B2 * 6/2012 Chenelia ..... A44B 11/005 81/3.09
8,533,866 B1 * 9/2013 Lindquist ..... A44B 1/18 2/96
8,793,919 B1 * 8/2014 Probst, Jr. ..... F41C 27/00 42/108
9,302,383 B2 * 4/2016 Barr ..... B25F 1/00
9,434,060 B1 * 9/2016 Grinalds ..... B25F 1/00
2003/0188399 A1 10/2003 Altrich et al.
2014/0123437 A1 * 5/2014 Hanson ..... G09F 23/00 24/40

* cited by examiner

BUTTON MANIPULATION DEVICE AND METHOD OF USE THEREOF

CROSS-REFERENCE TO RELATED APPLICATIONS

This application claims benefit of priority from U.S. Provisional Patent Application No. 62/506,919 filed on May 16, 2017, the disclosure of which is incorporated herein by reference in its entirety.

BACKGROUND

1. Technical Field

The present disclosure relates generally to assistance devices for manipulating small objects. More particularly, the present disclosure relates to assistance devices for directly manipulating a button, such as through a buttonhole.

2. Description of Related Art

Manipulation of small objects can be a frustrating task, especially for those with limited use of their hands. One particular example involves fastening buttons on articles of clothing, where it may be difficult to manipulate a button through a buttonhole.

Current attempts have been made to address this problem. For example, some designs include a hook or loop that is placed around a button to engage the thread by which the button is attached to pull the button through a buttonhole. However, these designs are more difficult to control because they engage the thread rather than the button. Furthermore, use of these designs can damage the thread attaching the button or the material of the buttonhole.

Based on the foregoing, there is a need in the art for a device to manipulate a button through a buttonhole with no damage to threads or to a buttonhole.

The above problems in the related art are considered as matters that have been addressed by the inventor to derive the present inventive concept, or as matters discovered during the course of deriving the present inventive concept. Thus, the problems may not be simply referred to as information that was known to the general public prior to filing the present disclosure.

SUMMARY OF EMBODIMENTS

Various embodiments of the present disclosure include button manipulation device for directly controlling a button. The device includes a rod-like base portion including a first concave surface formed at a first end thereof; a head portion including a second concave surface formed at a second end thereof; and a flexible body portion connecting the first end of the base portion and the second end of the head portion, wherein the first concave surface, the second concave surface, and an interior surface of the flexible body portion form a docking port into which the button is inserted and countersunk.

In an exemplary embodiment, the device further includes a latch formed at the first end of the base portion opposite to the flexible body portion; and a lip protrusion formed at the second end of the head portion opposite to the flexible body portion, wherein the latch and the lip hold the inserted button in the docking port.

In another exemplary embodiment, the latch and the lip protrusion each include a convex or beveled surface.

In another exemplary embodiment, the head portion includes a flat surface that, when pressed, causes the flexible body portion to flex in a direction to further separate the latch and the lip to release the inserted button.

In another exemplary embodiment, the head portion includes a smooth, rounded end opposite to the second end for guiding the device through a buttonhole.

In another exemplary embodiment, the flexible body portion is slidably adjustable to increase or decrease a distance between the first concave surface and the second concave surface.

In another exemplary embodiment, the body portion includes a lower body portion having a rail and an upper body portion having a track, and wherein the rail is inserted into and slidable on the track.

In another exemplary embodiment, the device further includes a plurality of wings formed on the body portion for aligning the device through a buttonhole.

Various embodiments of the present disclosure include method for directly controlling a button using a button manipulation device. The button manipulation device includes a rod-like base portion including a first concave surface formed at a first end thereof, a head portion including a second concave surface formed at a second end thereof, and a flexible body portion connecting the first end of the base portion and the second end of the head portion, wherein the first concave surface, the second concave surface, and an interior surface of the flexible body portion form a docking port. The method includes inserting the button in the docking port such that the button is countersunk therein.

In an exemplary embodiment, the method further includes securing the inserted button in the docking port using a latch formed at the first end of the base portion opposite to the flexible body portion and a lip protrusion formed at the second end of the head portion opposite to the flexible body portion.

In another exemplary embodiment, the inserting the button in the docking port includes inserting one side of the button toward the second concave surface and the interior surface of the flexible body portion such that the one side of the button is held in place by the lip; and rotating the device toward an opposite side of the button such that the button snaps into place within the docking port.

In another exemplary embodiment, the method includes inserting the device through a buttonhole in a first direction toward the button prior to inserting the button in the docking port; after inserting the button into the docking port, pulling the device and the inserted button through the buttonhole in a second direction opposite of the first direction; and releasing the button from the docking port when the button is pulled through the buttonhole to fasten the button to the buttonhole.

In another exemplary embodiment, the releasing the button from the docking port includes pressing a flat surface formed on the head portion to cause the flexible body portion to flex in a direction to further separate the latch and the lip to release the inserted button.

In another exemplary embodiment, the method further includes guiding the button manipulation device through the buttonhole using a plurality of wings formed on the body portion.

In another exemplary embodiment, the method further includes slidably adjusting a length of the flexible body portion to increase or decrease a distance between the first concave surface and the second concave surface.

The foregoing, and other features and advantages, will be apparent from the following, more particular description of the exemplary and preferred embodiments, the accompanying drawings, and the claims.

BRIEF DESCRIPTION OF THE DRAWINGS

The present disclosure will become more fully understood from the specification and the accompanying drawings, wherein.

DETAILED DESCRIPTION OF EMBODIMENTS

Figure 1:
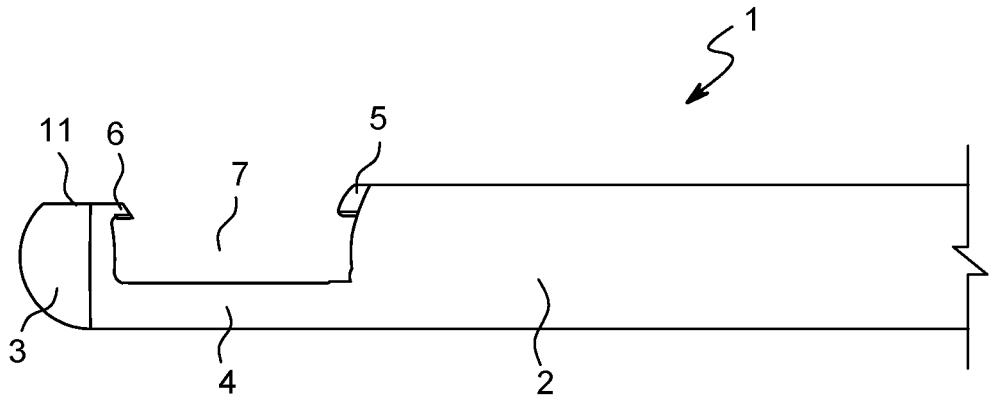
FIG. 1 is a side view of an exemplary device configuration according to various embodiments.

The following description is merely exemplary in nature and is in no way intended to limit the various embodiments, their application, or uses. It should be understood that the terminology used herein is used for the purpose of describing particular embodiments only, and is not intended to limit the scope of the present disclosure. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may. Features that are described in the context of separate embodiments may also be provided in combination in a single embodiment. Conversely, various features that are, for brevity, described in the context of a single embodiment, may also be provided separately or in any suitable subcombination. New claims may be formulated to such features and/or combinations of such features during the prosecution of the present application or of any further application derived therefrom.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the various embodiments of the present disclosure. Structures described herein are to be understood also to refer to functional equivalents of such structures.

It should be understood that steps within a method may be executed in different order without altering the principles of the present disclosure. Additionally, the components and/or elements recited in any apparatus or system claim may be assembled or otherwise operationally configured in a variety of permutations and are accordingly not limited to the specific configuration recited in the claims.

As will be understood by one skilled in the art, all ranges recited herein also encompass any and all possible sub-ranges and combinations of sub-ranges thereof, as well as the individual values making up the range, particularly integer values. Any listed range can be easily recognized as sufficiently describing and enabling the same range being broken down into at least equal halves, thirds, quarters, fifths, or tenths. A recited range (e.g., weight percent, absolute weight) includes each specific value, integer, decimal, or identity within the range. As will also be understood by one skilled in the art, all language such as "up to," "at least," greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specified values recited for radicals, substituents, and ranges, are for illustration only; they do not exclude other defined values or other values within defined ranges for radicals and substituents.

The drawings described herein are for illustrative purposes only of selected embodiments and not all possible implementations, and are not intended to limit the scope of any of the various embodiments disclosed herein or any equivalents thereof. It is understood that the drawings are not drawn to scale. For purposes of clarity, the same reference numbers will be used in the drawings to identify similar elements.

Exemplary embodiments will now be described in detail with reference to the accompanying drawings.

FIG. 1 is a side view of a button manipulation device 1 according to various embodiments.

Figure 2:
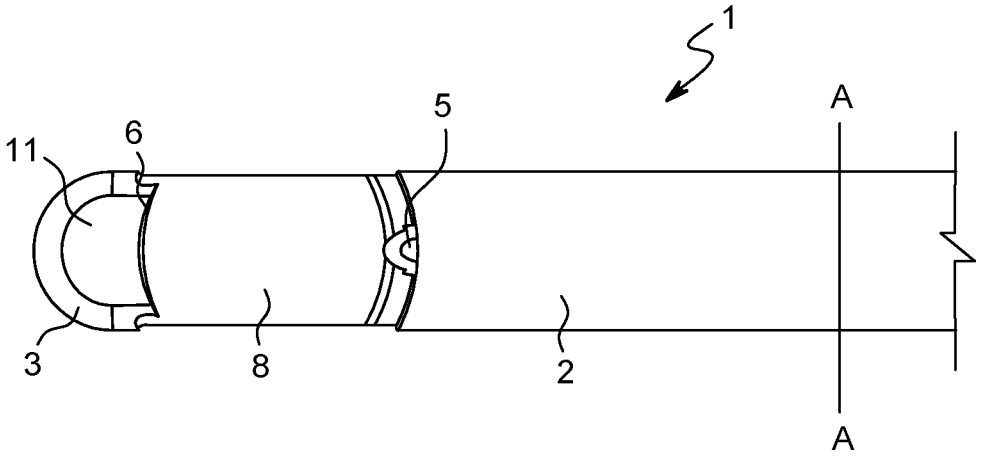
FIG. 2 is a plan view of an exemplary device configuration according to various embodiments.

FIG. 2 is a plan view of the button manipulation device 1 according to various embodiments.

Figure 3:
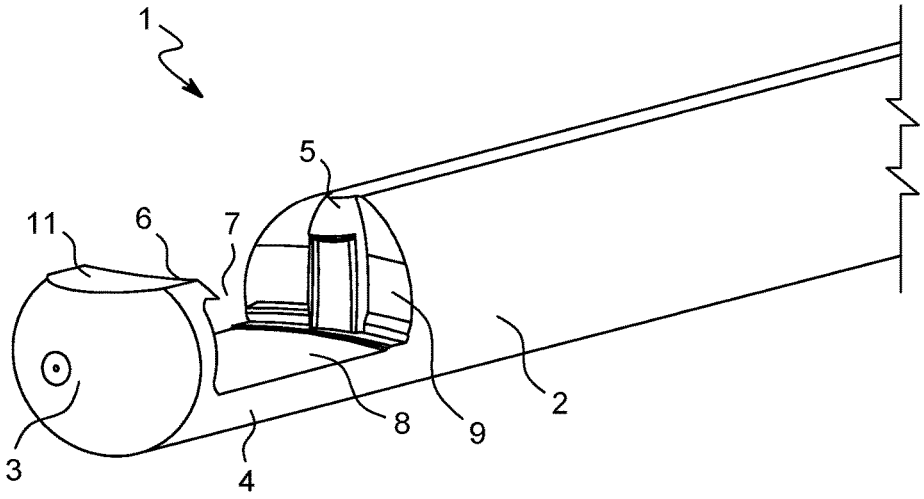
FIG. 3 is a front perspective view of an exemplary device configuration according to various embodiments.
Figure 4:
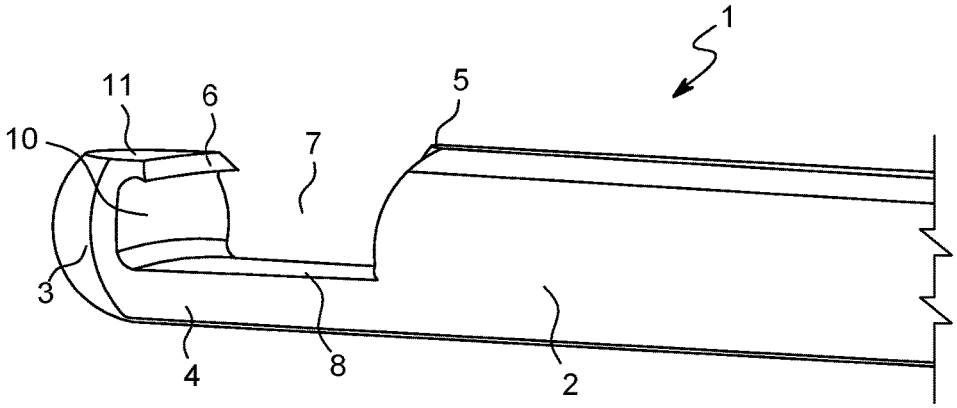
FIG. 4 is a rear perspective view of an exemplary device configuration according to various embodiments.

FIGS. 3 and 4 are perspective views of the button manipulation device 1 according to various embodiments.

Referring to FIGS. 1-4, the button manipulation device 1 may be used to manipulate a small object, such as a button. For example, the button manipulation device 1 may be used to engage and guide a button through a buttonhole of an article of clothing. The device 1 is generally cylindrical, or rod-like, in shape and may have at least one rounded end. The button manipulation device 1 may be formed of plastic, metal, wood, or the like through molding, pressing, carving, or other suitable means.

The button manipulation device 1 comprises a base portion 2, a head portion 3, and a flexible body portion 4 that connects the base portion 2 and the head portion 3. The device 1 further comprises a latch 5 and a lip 6 formed on an end of the base portion 2 and an end of the head portion 3, respectively, opposite of the flexible body portion 4. The proximal surfaces of the base portion 2, head portion 3, flexible body portion 4, latch 5, and lip 6 form a docking port 7 into which a button may be received and held in place. In particular, the interior surface 8 of the flexible body portion 4 engages a front face of a button, the concave interior surface 9 of the base portion 2 and the concave interior surface 10 of the head portion 2 engage the sides of the button, and the latch 5 and lip 6 engage opposite ends of the rear face of the button.

The shape of the concave interior surface 9 of the base portion 2 and the concave interior surface 10 of the head portion 3 may vary to accommodate different sized buttons. Similarly, the length of flexible body portion 4 may be statically constructed of various lengths in order to accommodate different sized buttons. In some embodiments, the flexible body portion 4 may be slidably adjustable to various lengths to accommodate different sized buttons. For example, the flexible body portion 4 may extend to increase the distance between the concave interior surfaces 9, 10 to accommodate larger buttons, or the flexible body portion 4 may contract to decrease the distance between the concave surfaces 9, 10 to accommodate smaller buttons.

In some embodiments, the latch 5 and lip 6 may have convex or beveled exterior surfaces to help guide a button into the docking port 7. Similarly, the distal end of the head portion 3 may be smooth and rounded for threading through a buttonhole. While the interior surface 8 of the flexible body portion 4 may be generally flat, in some embodiments, a raised contour(s) may be formed thereon for better fit and control of a docked button.

The head portion 3 also includes a flat surface 11 proximate to the docking port 7. Force or pressure exerted on the flat surface 11 causes the flexible body portion 4 to flex in a direction to further separate the latch 5 and the lip 6 and release an inserted button. For example, the flat surface 11 may be pressed on the body to cause the flexible body portion 4 to flex and release a button while fastening a button using the device 1.

Figure 5:
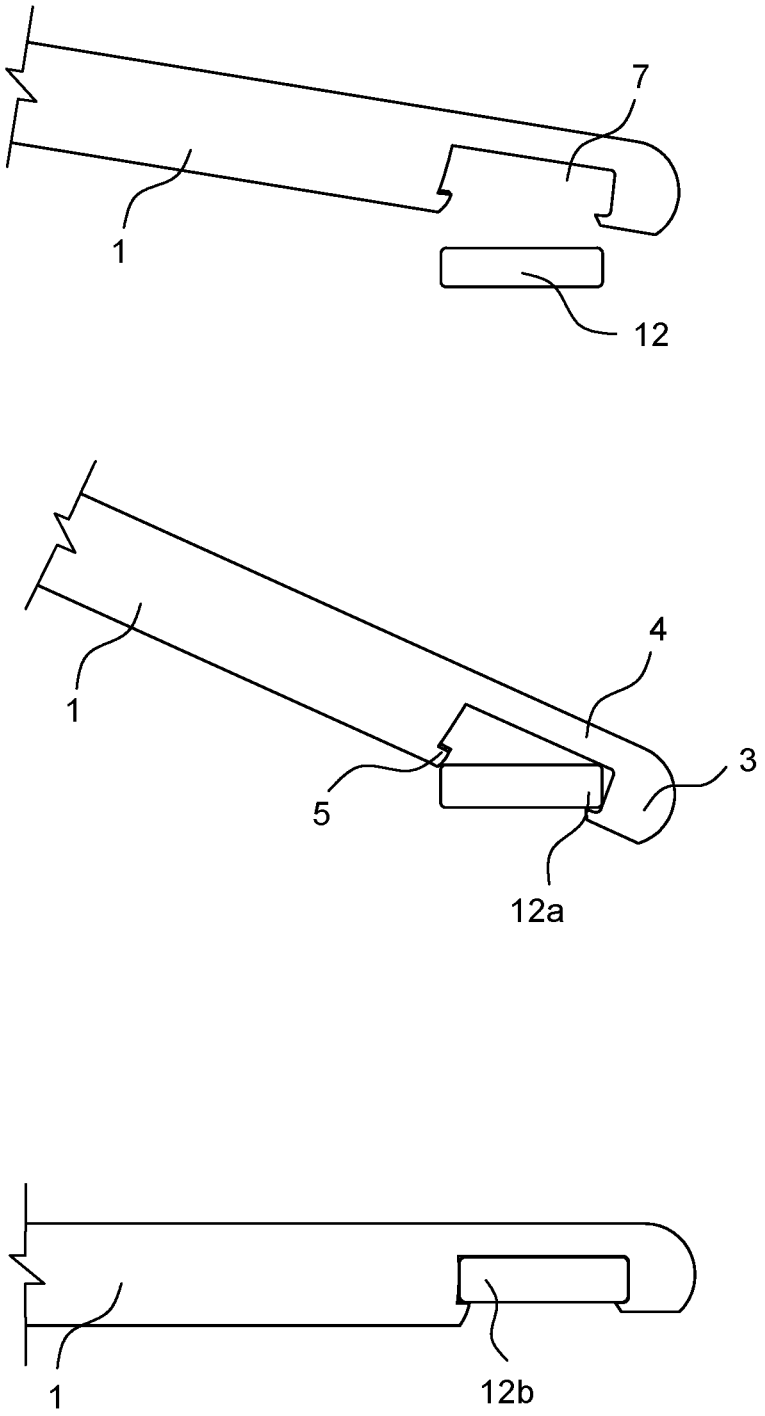
FIG. 5 is an illustration of exemplary method steps of using an exemplary device configuration according to various embodiments.

FIG. 5 is an illustration of exemplary method steps to dock a button 12 with the button manipulation device 1 according to various embodiments.

Referring to FIG. 5, the button manipulation device 1 is first maneuvered such that the docking port 7 is aligned with the button 12. Next, one side 12*a* of the button 12 is inserted in the docking port 7 toward the concave interior surface 10 of the head portion 3 and the interior surface 8 of the flexible body portion 4, and held in place by the lip 6. The button manipulation device 1 is then rotated toward the side 12*b* of the button 10 such that the button 12 contacts the latch 5. The curved exterior surface of the latch 5 guides the button 10 as the device 1 is rotated until the button 12 snaps into place within the docking port 7 and held in place by the latch 5 and lip 6. Once the button 12 is countersunk within the docking port 7, the button 12 may be fully controlled by manipulating the device 1.

In some embodiments, an object may be hung from or attached to the button manipulation device 1 and/or the button 12 that have been docked together. For example, a pocket watch chain (not shown) may be wrapped around the button 12 and/or the button thread (not shown), and the button manipulation device 1 may be docked with the button 12 to lock secure the pocket watch chain in place. Alternatively or additionally, the chain or other object may be secured between the interior surface 8 of the flexible body portion 4 and the face of the button 4.

Figure 6:
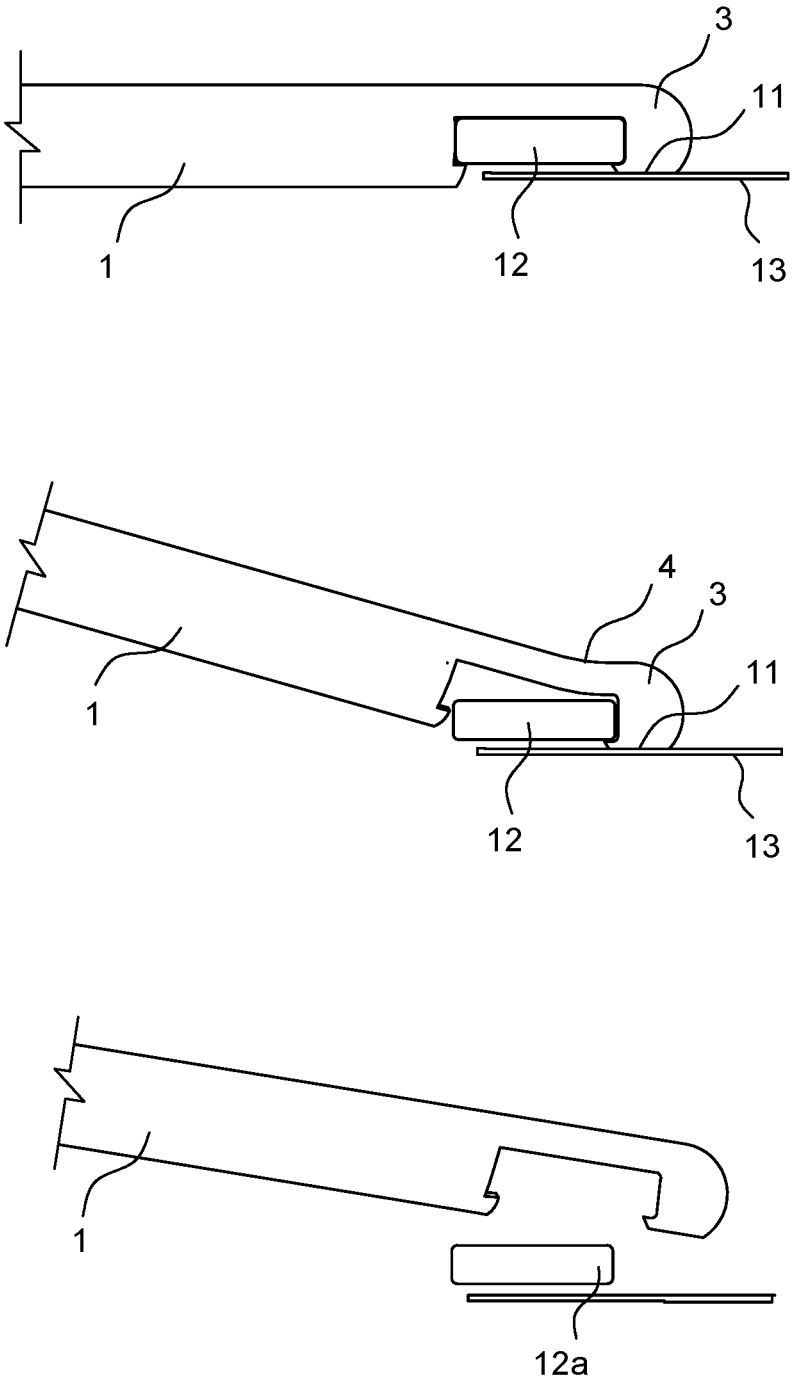
FIG. 6 is an illustration of exemplary method steps of using an exemplary device configuration according to various embodiments.

FIG. 6 is an illustration of exemplary method steps to release a button 12 from the button manipulation device 1 according to various embodiments.

Referring to FIG. 6, pressure is first exerted on the flat surface 11 of the head portion in order to release the button 12 from the device 1. For example, this may be accomplished by pressing the flat surface 11 against the body or other surface 13. When pressure is exerted on the flat surface 11, the flexible body portion 4 is flexed such that the opening of the docking port 7 between the latch 5 and lip 5 becomes wider. When the opening of the docking port 7 becomes wide enough, the side 12*b* of the button 12 is released by the latch 5. The device 1 may then be maneuvered away from the side 12*a* of the button 12 to completely release the button 12. In some embodiments, the button 12 is flipped over the clothing material adjacent to a buttonhole when the side 10*a* of the button 12 is released by the lip 5. The flipping of the button 12 upon release leads to proper placement of the button 12 over the clothing.

Figure 7:
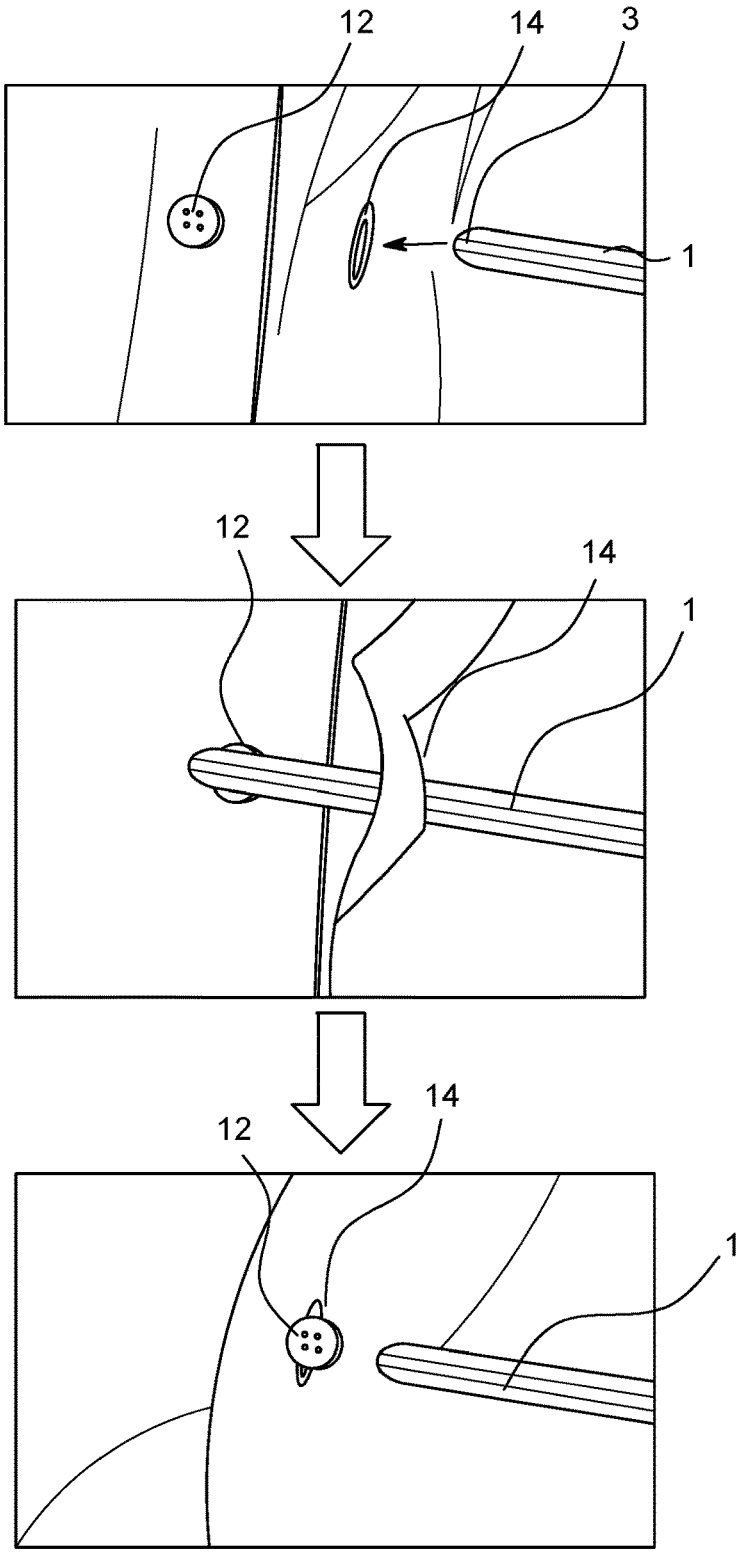
FIG. 7 is an illustration of exemplary method steps of using an exemplary device configuration according to various embodiments.

FIG. 7 is an illustration of exemplary method steps to fasten a button 12 through a buttonhole 14 using the button manipulation device 1 according to various embodiments.

Referring to FIG. 7, the head portion 3 end of the device 1 is first inserted through the buttonhole 14 in a first direction toward the button 12. In other words, the first direction in which the device 1 is inserted through the buttonhole 14 is opposite to the direction in which the button 12 needs to pass through the buttonhole 14 in order to fasten the button 12. Then, the device 1 is maneuvered toward the button 12 and docked with the button 12. For example, the manner in which the button 12 is docked with the device 1 may be similar to the method steps discussed above with reference to FIG. 5.

Once the button 12 is docked with the device 1, the device 1 is pulled in a second direction opposite to the first direction such that the docked button 12 passes through the buttonhole 14. After the docked button 12 has passed through the buttonhole 14, the button 12 may be released from the device 1. For example, the manner in which the button 12 is released from the device 1 may be similar to the method steps discussed above with reference to FIG. 6. Accordingly, the button manipulation device 1 enables the button 1 to directly be controlled and easily passed through the buttonhole 14, leaving the button 12 fastened without any damage to the thread attaching the button or to the buttonhole material.

Figure 8:
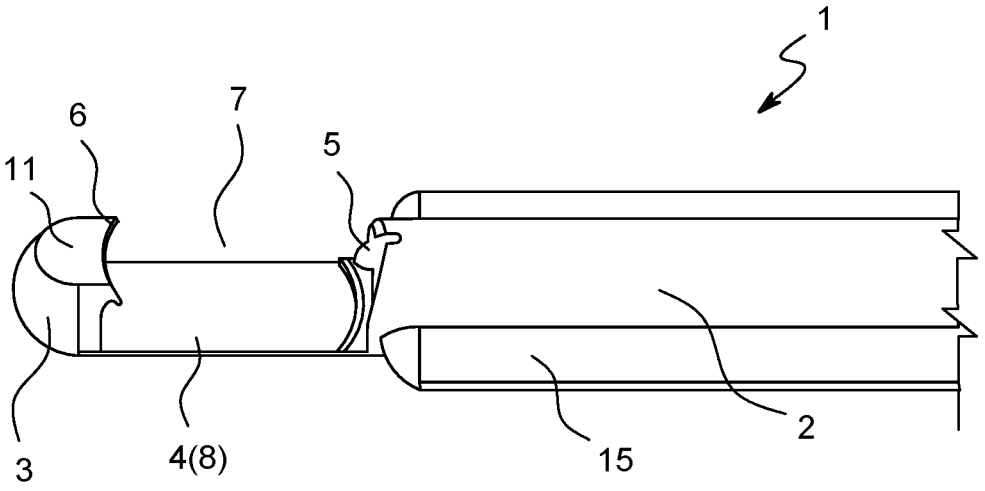
FIG. 8 is a perspective view of an exemplary device configuration according to various embodiments.

FIG. 8 is a perspective view of the button manipulation device 1 according to various embodiments. In FIG. 8, the same reference numerals as those of FIG. 1 denote the same elements. Thus, the differences of the exemplary embodiment(s) illustrated with reference to FIG. 8 from the exemplary embodiment(s) illustrated with reference to FIG. 1 will be described below.

Referring to FIG. 8, in some embodiments, the body portion 2 comprises two wings 15 that protrude on opposite sides along the length of the body portion 2. The wings 15 ensure proper alignment of the device 1 and the docked button 12 as it passes through the buttonhole 14 to fasten the button 12. The wings 15 may be suitably formed to extend laterally from the sides of the body portion 2 at various widths to correspond to different sized buttons and buttonholes.

Figure 9A:
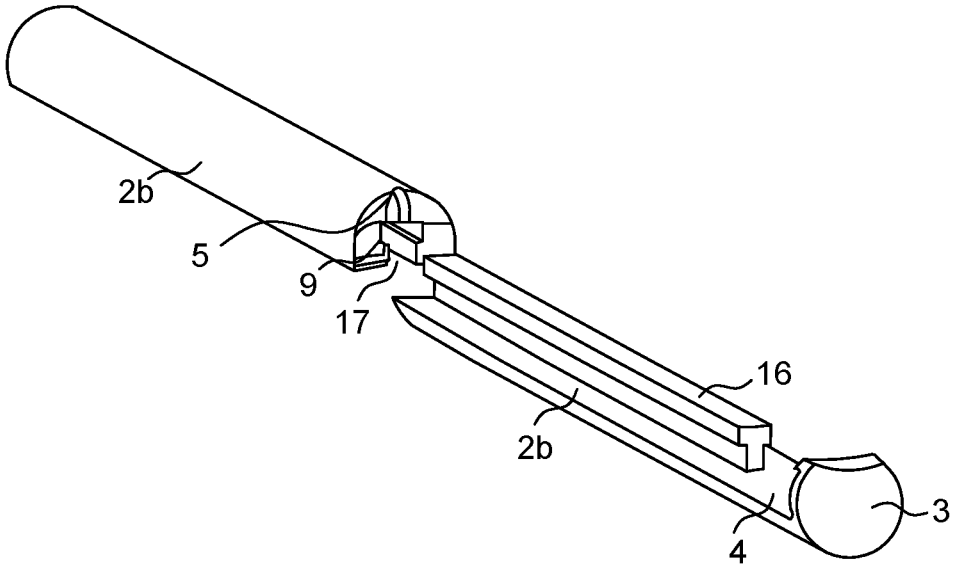
FIG. 9A is an illustration of various aspects of an exemplary device configuration according to various embodiments.
Figure 9B:
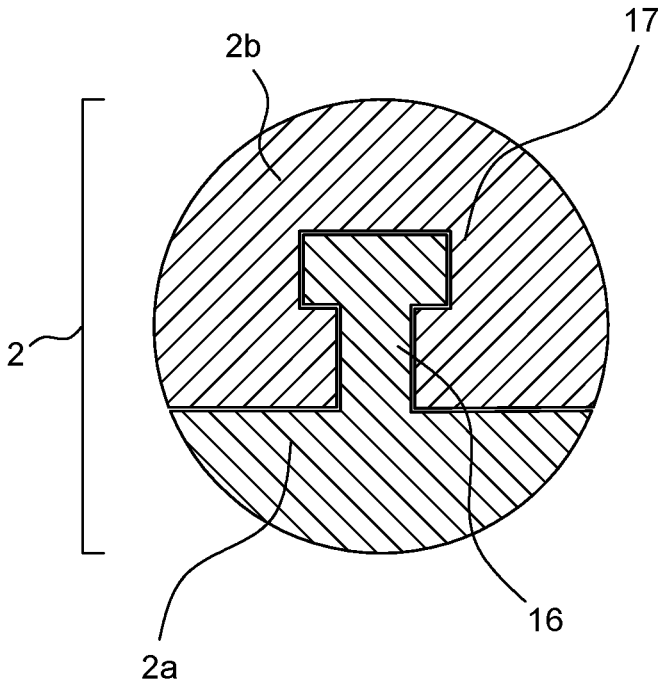
FIG. 9B is a cross-sectional view of an exemplary device configuration along line A-A in the plan view of FIG. 2 according to various embodiments.
Figure 9C:
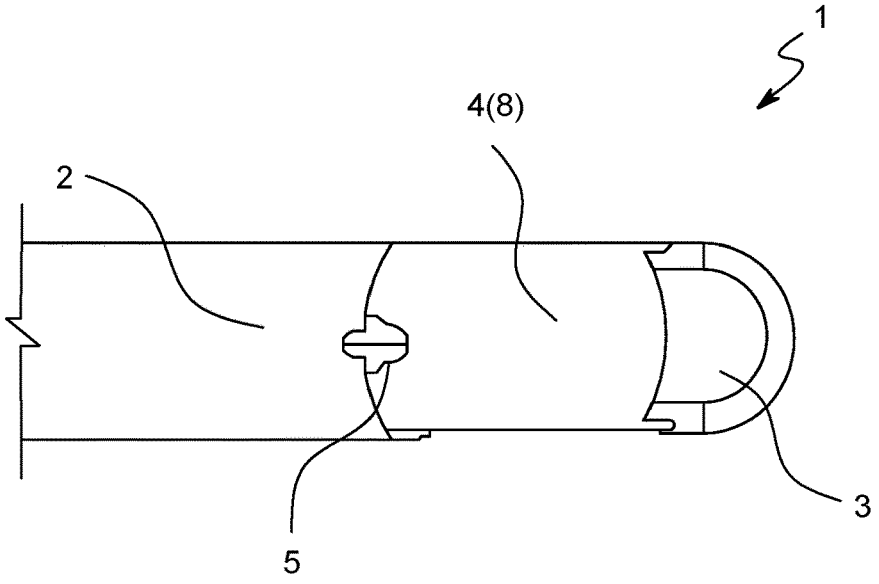
FIGS. 9C-D are plan views of exemplary device configurations according to various embodiments.
Figure 9D:
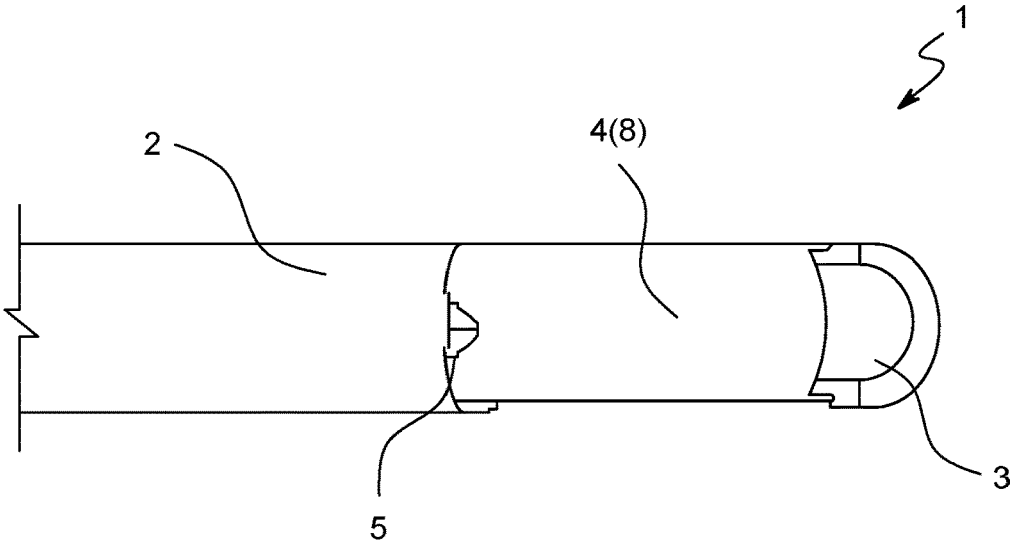

FIG. 9A is an illustration of various aspects of the button manipulation device 1 according to various embodiments. FIG. 9B is a cross-sectional view of the button manipulation device 1 along line A-A in the plan view of FIG. 2 according to various embodiments. FIGS. 9C-D are plan views of the button manipulation device 1 according to various embodiments. In FIGS. 9A-D, the same reference numerals as those of FIG. 1 denote the same elements. Thus, the differences of the exemplary embodiment(s) illustrated with reference to FIGS. A-D from the exemplary embodiment(s) illustrated with reference to FIG. 1 will be described below.

Referring to FIGS. 9A-D, in some embodiments, the body portion 2 comprises a lower body portion 2*a* having a T-shaped rail 16 and an upper body portion 2*b* having a corresponding T-shaped groove 17. In an embodiment, the rail 16 and the groove 17 extend the entire length of the lower body portion 2*a* and the upper body portion 2*b*, respectively. Thereby, the rail 16 may be inserted into the groove 17, as shown in FIG. 9B, and the lower body portion 2*a* and/or the upper body portion 2*b* may be slid to adjust the exposed length of flexible body portion 4 to accommodate for larger or smaller buttons. For example, the flexible body portion 4 in FIG. 9C has a shorter length than the flexible body portion 4 in FIG. 9D, which may be achieved by sliding the lower body portion 2*a* and/or the upper body portion 2*b* to shorten or lengthen the distance between the concave interior surface 9 of the base portion 2 and the concave interior surface 10 of the head portion 2. Although the rail 16 and the groove 17 are illustrated as being T-shaped, other suitable shapes may be used as appropriate.

Various embodiments have been described with reference to the accompanying drawings. As is apparent from the foregoing description, the various embodiments address the need in the art for a device to manipulate a button through a buttonhole with no damage to threads or to a buttonhole. Particularly, the button manipulation device 1 according to various embodiments directly engages and secures a button for greater control while fastening a button through a buttonhole over the related art devices that engage the button thread. This may be particularly useful for those with limited use of their hands. Furthermore, directly controlling the button through the buttonhole, rather than pulling the button through the buttonhole by the thread, reduces the risk of damaging the thread and the material surrounding the buttonhole.

Additionally, although the disclosed subject matter has been described in conjunction with specific embodiments, numerous modifications and alterations are well within the scope of the present disclosure. Accordingly, the specification and drawings are to be regarded in an illustrative rather than a restrictive sense.

What is claimed:

1. A button manipulation device for directly controlling a button comprising:

a rod base portion;

a head portion;

a flexible body portion;

the rod base portion comprising a first end, a latch and a first concave surface;

the latch and the first concave surface each being formed at the first end;

the latch being extended from the first concave surface;

the head portion comprising a second end, a lip protrusion and a second concave surface;

the lip protrusion and the second concave surface each being formed at the second end;

the lip protrusion being extended from the second concave surface;

the latch and the lip protrusion being oppositely located to each other;

the first concave surface and the second concave surface being oppositely located to each other;

the flexible body portion being connected in between the rod base portion and the head portion;

the flexible body portion comprising an interior surface;

the interior surface being connected in between the first concave surface and the second concave surface;

the latch and the lip protrusion each being cantilevered over the interior surface;

the latch comprising a latch edge;

the lip protrusion comprising a lip protrusion edge;

the latch edge and the lip protrusion edge each being tapered towards the interior surface;

the latch, the lip protrusion, the first concave surface, the second concave surface and the interior surface form a docking port;

the docking port being configured to receive a button;

the latch and the lip protrusion being configured to hold the button; and the button being inserted and countersunk within the docking port and held by the latch edge and the lip protrusion edge in response to the docking port receiving the button.

2. The button manipulation device according to claim 1, wherein the latch and the lip protrusion each comprises a convex surface or a beveled surface.

3. The button manipulation device according to claim 1, wherein the head portion comprises a flat surface, the lip protrusion being located in between the flat surface and the flexible body portion, and the latch and the lip protrusion move away from each other so as to release the button when the flat surface is pressed to cause the flexible body portion to flex in a direction.

4. The button manipulation device according to claim 1, wherein the head portion comprises a smooth rounded end, the smooth rounded end is oppositely located to the second end, and the smooth rounded end is configured to guide the button manipulation device through a buttonhole.

5. The button manipulation device according to claim 1, wherein the flexible body portion is slidably adjustable to increase or decrease a distance between the first concave surface and the second concave surface.

6. The button manipulation device according to claim 1, wherein the flexible body portion comprises a lower body portion having a rail and an upper body portion having a track, and the rail is inserted into and slidable on the track.

7. The button manipulation device according to claim 1 comprising a plurality of wings formed on the rod base portion, the plurality of wings being configured to align the button manipulation device through a buttonhole.

8. A method for directly controlling a button comprising:

providing a button manipulation device as claimed in claim 1;

providing a button;

inserting the button in the docking port such that the button is countersunk within the docking port.

9. The method according to claim 8 comprising securing the button in the docking port by using the latch and the lip protrusion.

10. The method according to claim 8, wherein inserting the button in the docking port comprises:

inserting one side of the button toward the second concave surface and the interior surface such that the one side is held in place by the lip protrusion; and rotating the button manipulation device toward an opposite side of the button such that the button snaps into place within the docking port.

11. The method according to claim 8 comprising:

providing a buttonhole;

inserting the button manipulation device through the buttonhole in a first direction toward the button prior to inserting the button in the docking port;

after inserting the button into the docking port, pulling the button manipulation device and the button through the buttonhole in a second direction opposite of the first direction; and releasing the button from the docking port when the button is pulled through the buttonhole to fasten the button to the buttonhole.

12. The method according to claim 11, wherein releasing the button from the docking port comprises pressing a flat surface formed on the head portion to cause the flexible body portion to flex in a direction to further separate the latch and the lip protrusion to release the button.

13. The method according to claim 11 comprising guiding the button manipulation device through the buttonhole by using a plurality of wings formed on the flexible body portion.

14. The method according to claim 8 comprising slidably adjusting a length of the flexible body portion to increase or decrease a distance between the first concave surface and the second concave surface.

* * * * *